US006943321B2

(12) United States Patent
Carbone et al.

(10) Patent No.: US 6,943,321 B2
(45) Date of Patent: Sep. 13, 2005

(54) CONVECTION OVEN WITH FORCED AIRFLOW CIRCULATION ZONES

(75) Inventors: Philip Carbone, North Reading, MA (US); Peter Pescatore, Wakefield, MA (US); Steve Hobson, Arlington, MA (US); Matthew Brekken, Boston, MA (US)

(73) Assignee: Wolf Appliance Company, LLC, Fitchburg, WI (US)

( * ) Notice: Subject to any disclaimer, the term of this patent is extended or adjusted under 35 U.S.C. 154(b) by 170 days.

(21) Appl. No.: 10/233,156

(22) Filed: Aug. 30, 2002

(65) Prior Publication Data

US 2004/0040950 A1 Mar. 4, 2004

(51) Int. Cl.[7] ..... A21B 1/00

(52) U.S. Cl. ..... 219/400; 219/412; 219/507; 219/702; 219/715; 219/720; 126/21 A

(58) Field of Search ..... 219/412, 400, 219/507, 702, 715, 720; 126/21 A

(56) References Cited

U.S. PATENT DOCUMENTS

| | | | | |
|---|---|---|---|---|
| 3,797,473 A | | 3/1974 | Mutchler | |
| 4,071,739 A | | 1/1978 | Jenn et al. | |
| 4,308,853 A | | 1/1982 | Thirode | |
| 4,503,760 A | | 3/1985 | Pryputsch et al. | |
| 4,951,645 A | | 8/1990 | Luebke et al. | |
| 5,485,780 A | * | 1/1996 | Koether et al. | 99/419 |

* cited by examiner

*Primary Examiner*—Shawntina Fuqua
(74) *Attorney, Agent, or Firm*—Foley & Lardner LLP

(57) ABSTRACT

At least two blowers are controlled with baffles to create circulating zones of airflow which circulate in a substantially horizontal plane within a convection oven cavity. This airflow minimizes the potential for airflow paths to be broken up or blocked by the configuration of objects placed in the oven. The substantially horizontal airflow reduces the non-uniformity of air temperature distribution within the oven cavity. The blowers may be controlled to rotate either simultaneously or alternately, depending on the selected mode of operation. The blowers and associated heating elements are controlled to operate in various cooking modes by the controller in response to a mode selector input.

14 Claims, 14 Drawing Sheets

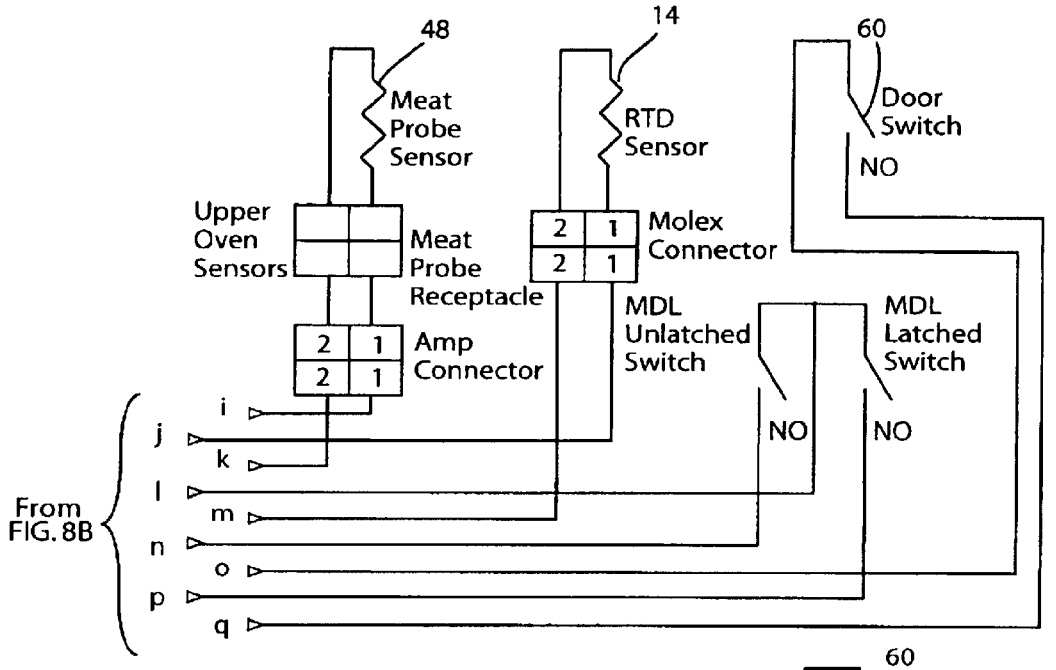
FIG. 8E
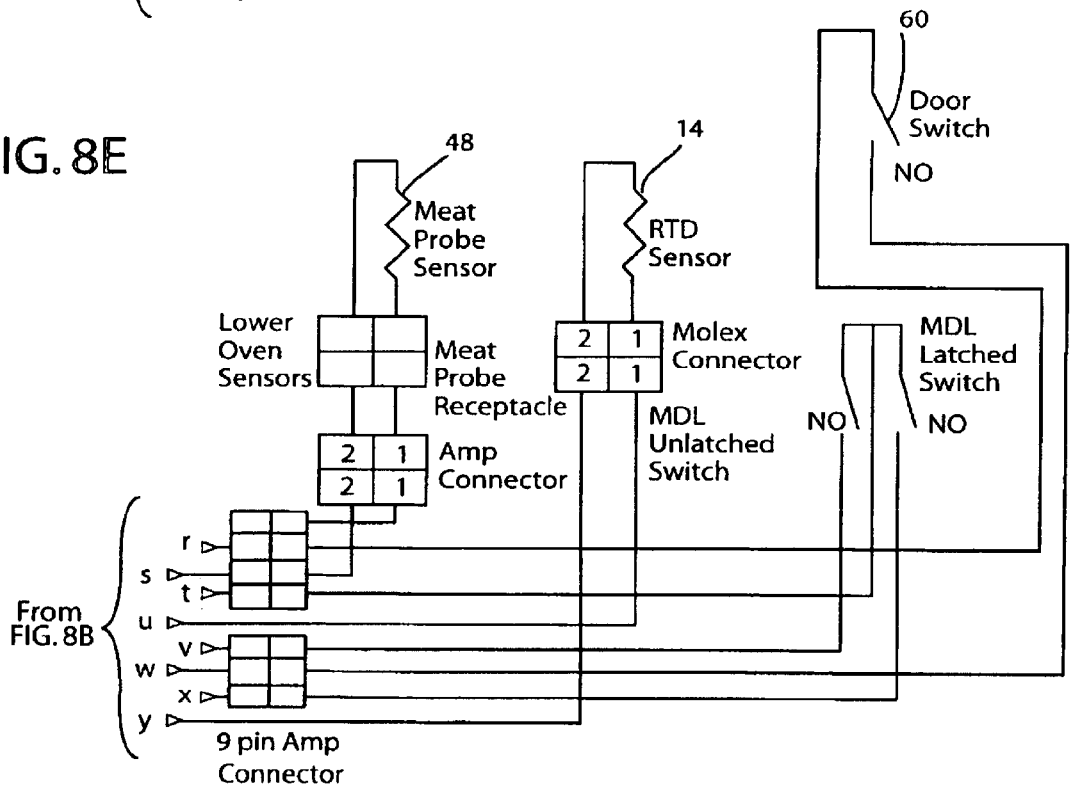

CONVECTION OVEN WITH FORCED AIRFLOW CIRCULATION ZONES

FIELD OF THE INVENTION

This invention pertains generally to the field of convection ovens, and more particularly to convection ovens employing blowers to manage airflow in the oven cavity, and methods of controlling and using such ovens.

BACKGROUND OF THE INVENTION

A convection oven heats an object in an oven cavity by transferring heat energy from heating elements to the object by circulation of a gas within the oven cavity. Typically, a thermal sensor senses the temperature of the gas and a regulator controls the operation of the heating elements in response to the sensed temperature to maintain a desired operating temperature in the oven cavity. Although the circulated gas in a convection oven for cooking food is typically air, other gases may be employed such as nitrogen, steam, or combustion gases from gas-fired burners, depending upon the oven application. Thus, although convection ovens are commonly used for cooking and baking food, convection oven applications are not limited to cooking and baking. Convection ovens may also be employed in industrial or commercial applications that do not directly cook food.

In a standard oven, the oven cavity temperature is controlled by a temperature regulator that turns a heating element on or off as necessary. Convection oven heating elements typically consist of either a gas-fired combustion chamber separate from the oven cavity, or a resistive heating element energized by an electric current, but may also include other types of heating elements such as, for example, an infrared energy source.

A major problem in convection ovens used for cooking food has been obtaining uniform heating of the food products in the oven. This problem is aggravated when food is placed on cooking racks at multiple elevations within the oven compartment. Maintaining high food quality requires even and thorough cooking of food throughout the oven cavity. Minimizing cooking time strongly depends upon the distribution of hot air throughout the oven cavity during cooking. The distribution of hot air is strongly impacted, for example, by opening the oven door. Thus, because airflow is such an important factor in achieving uniform air temperature distribution, managing the airflow in the oven cavity is the key to improving both the quality of cooked food and the time required to cook the food in a convection oven.

It is well understood that using a blower, such as a fan, to promote air circulation can dramatically improve the uniformity of air temperature distribution within the oven cavity of a convection oven. However, unmanaged air flow can still be uneven, leading to undesirable drying of foods, causing batters to lean, and over-browning the edges of bakery items such as cakes and muffins.

Convection ovens typically employ one of three types of air circulation arrangements in combination with conventional resistive heating elements. Each type of air circulation arrangement provides a different degree of control over air temperature distribution in the oven cavity. The first type of air circulation arrangement, passive circulation, takes advantage of naturally rising convection currents within the oven cavity. Such a passive arrangement has no ability to manage airflow, however. The second type of air circulation arrangement, as described, for example in U.S. Pat. No. 4,071,739, employs an unheated blower to force air to circulate in the oven cavity. Because the heat source and the blower are physically separate, this system provides limited control over air temperature distribution. The third type of air circulation arrangement forces air into the oven cavity after heating the air by a heating element positioned adjacent to the blower. This third type permits the best management of hot air temperature distribution in the oven cavity.

Several methods of improving food quality and reducing cooking time using forced hot air circulation directly to cook the food are known. One such method is disclosed in U.S. Pat. No. 4,308,853. In this method, a blower forces hot air through a system of mechanical passageways that guide the hot air to food located in a series of vertically stacked compartments. Two zones of airflow are established in each compartment: a laminar flow zone heats the bottom of the food and a turbulent flow zone heats the top of the food. Such an oven is limited, however, to food that fits into fixed-height compartments. This patent also describes forcing air from one side of the oven to an intake on the opposite side of the oven thereby creating substantially linear airflow through the oven cavity. This arrangement requires rotating the food around the vertical axis. Another previous attempt to improve airflow management in a convection oven using forced circulation has employed a baffle with exhaust openings on the top and bottom as well as the sides thereof. Such a baffle is used to direct the airflow from a blower, resulting in a "toroidal" airflow in which the centrally located blower intakes air omni-directionally from an empty cavity. See, for example, U.S. Pat. No. 3,797,473. However, when food is placed in such an oven, the airflow can be significantly blocked, particularly in the non-horizontal plane, resulting in turbulence and reduction in airflow effectiveness. Furthermore, the vertically circulating currents can experience divergent temperatures due to passive convection, leading to non-uniform temperature distribution. Other attempts to improve forced hot air convection involve fixing jets of hot air around the food (see U.S. Pat. No. 4,951,645), rotating the food itself (e.g., a rotisserie, see also U.S. Pat. No. 5,485,780), or rotating the hot air source (see U.S. Pat. No. 4,503,760). Each of these approaches has complexity, space, and/or cost drawbacks.

The time for the air temperature distribution to recover after an oven door is opened and re-closed is an important factor in determining cooking time. Because opening the oven door dramatically disrupts the hot air temperature distribution in the oven cavity, a forced air system shortens the recovery time and thereby improves overall cooking time. However, the improvement in recovery time in current convection ovens is limited by the airflow capacity that a single blower can provide to the oven cavity.

SUMMARY OF THE INVENTION

The present invention both enhances air temperature uniformity and minimizes heating time in a convection oven by using multiple blowers with multiple operating modes controlled to optimize convecting gas circulation for a variety of needs. A convection oven in accordance with the present invention includes oven walls and a door forming an oven chamber with a substantially enclosed chamber cavity in which objects are placed for processing, a controller, a sensor, a mode selector input, and at least two blowers to force gas to circulate in the chamber cavity substantially in the horizontal plane. At least one element for regulating temperature or humidity may be used in the present invention. In an exemplary embodiment of the invention, the oven is adapted for cooking food and it includes at least one element for heating the convecting gas, such as air. Based on feedback from a temperature sensor, the heating element and blower are regulated by the controller to achieve a temperature setpoint in a manner dictated by the mode selector input.

A preferred embodiment of the present invention includes an oven chamber with fixed, unheated cooking surfaces on the top wall, bottom wall, and on two side walls thereof. A door may be provided as the front wall of the oven chamber to permit food to be placed in and removed from the oven cavity. At least two blowers, preferably radial fans, are configured horizontally adjacent one another and positioned opposite the door. Preferably, the oven cavity and the blowers are in fluid communication through a baffle having apertures, such as slots, for example, that distribute and control the airflow from the blowers. The two blowers preferably counter-rotate, but may otherwise be identical. Each blower intakes air from the oven cavity and exhausts it across a heating element, thereby heating the air. The air then circulates through the baffle slots back into the oven cavity, forming distinct zones of circulation in the horizontal plane that extend from behind the baffle to the front wall of the oven cavity. Both blowers may be operated simultaneously at selected times to establish four horizontally adjacent and counter-rotating zones of airflow that circulate substantially in the horizontal plane. Food to be cooked can be placed on a plurality of adjustable-elevation horizontal racks in the oven cavity. The state of a mode selector input may determine the mode of cooking. The selector may correspond to at least two modes of operation: a first mode, in which the blowers alternate between on and off states of operation, with one blower turned on while the other blower is turned off, and a second mode in which all blowers run simultaneously. A controller regulates oven cavity air temperature by monitoring feedback from a temperature sensor positioned in the oven cavity and setting the operating state of the blowers and heating elements in accordance with the selected mode of cooking.

An oven in accordance with the present invention may have an oven chamber with six inner walls defining an oven cavity. Such a substantially enclosed chamber may be used for heating, baking, or roasting food, or for firing, baking, or drying objects, as in a kiln. In the preferred embodiment, the oven cavity contains convection blowers positioned opposite a door on a front wall, but the invention is not limited this configuration. The blowers could be mounted on any other wall of the oven cavity. Furthermore, having a door on the front wall of the oven cavity is not a requirement for this invention. The shape of the oven cavity is typically cubical, but it could be of any functional shape.

A blower employed in the present invention may be a fan arranged with a baffle, or may be other equivalent mechanisms for forced air circulation. A blower in the preferred embodiment employs a baffle with apertures designed to direct air into zones that circulate substantially in the horizontal plane, but a baffle is not necessary to obtain benefits from having additional blowers. The blower may be implemented as a fan of any suitable type. In the preferred embodiment, radial fans intake air from the cavity and thereby avoid blowing a localized high pressure airflow in a non-uniform manner toward the food. However, the invention is not limited to radial fan types, and it may be appropriate in some applications to promote such localized high pressure airflows. An axial fan, for example, might be advantageous in industrial convection oven applications.

An advantage of a convection oven in accordance with the present invention is that the convection airflow fields primarily circulate in the horizontal plane. Circulation in the horizontal plane minimizes the potential for airflow paths to be broken up or blocked by the configuration of objects placed on the horizontal grills or, as in a flow-through oven, on a conveyor system.

The configuration of blowers employed in a convection oven in accordance with the present invention may be expanded to more than two blowers, including more than two horizontally adjacent blowers in a row, and vertically stacked rows of blowers. Two or more blowers may be adjacently mounted in a horizontal row to produce an effective number of circulating airflow fields to the width of the oven. For ovens having a tall height relative to the effective height of the circulated airflow produced by a single horizontal row of blowers, additional rows of blower units can be stacked vertically to extend the effective height of circulating airflow fields.

The exemplary invention pertains to convection heating, but is applicable to any combination of cooking apparatus and methods, including, for example, convection heating in combination with microwave, radiant, or infrared heating.

The heating element in the preferred embodiment is a resistive element surrounding the perimeter of a radial fan, but the invention is not limited to heating elements that are directly within the exhaust of a blower or to resistive heating elements. Alternative heating element embodiments include, for example, infrared sources, gas-fired combustion chambers, and resistive heating elements fixed to a sidewall of the oven cavity.

Normal cooking temperatures range from about 150 degrees Fahrenheit to about 800 degrees Fahrenheit, although this is not a limitation of the invention. The airflow management provided by the present invention may be applied to achieve uniform temperature distribution in an enclosure at any temperature, including ambient or refrigerated temperatures. In combination with a humidity control mechanism, the airflow management provided by the present invention could also produce uniform and efficient product drying, curing, or moisturizing. Thus, the present invention may be adapted to provide efficient airflow management in a cavity with any combination of heating, refrigeration, or humidity control.

A preferred method of operating a convection oven in accordance with the present invention to cook food is in one of two operating modes, depending on the type of cooking required. In either preferred mode of operation, a heating element is permitted to turn on only when both the blower adjacent to it is on and when the controller commands it based on feedback from an oven temperature sensor.

A cooking mode selector input is preferably provided to allow a user to select the desired cooking mode. The cooking mode selector input may preferably be a multi-position switch arrangement, but it could be any other suitable digital, analog, or equivalent input for commanding the operating mode to a system controller. The controller is preferably a primarily digital circuit, but it could also be primarily analog, mechanical, or any equivalent suitable to control the heating elements and blowers based on temperature sensor feedback and mode selector input signals.

For convection-roast or convection-broil type cooking, the preferred method of operation is to run both blowers continuously in opposite directions. Such counter-rotating operation enhances airflow rate and establishes zones of airflow having uniform velocity to distribute air temperatures evenly.

For convection or convection-bake type cooking, the preferred method of operating the blowers is to turn on only one blower for a time, and then to turn it off while turning on the other blower. The optimal run period of each blower should permit the corresponding heating element enough time to reach adequate temperature for cooking, but should not be so long so as to permit the element to cause air temperatures to be created in the oven that would result in, for example, the undesired edge-browning of bakery items.

A convection oven with forced airflow circulation zones in accordance with the present invention has many advantages. In addition to enhancing food quality and reducing cooking time, incorporating at least two blowers establishes a plurality of airflow zones. Through proper selection of operating mode for the blower units, the adjacent blower configuration may be used to optimize airflow in the oven cavity for different cooking methods. The present invention is also cost effective in that it permits increased airflow volume using small, low-cost blowers and open coil heating elements that do not significantly increase system cost. A side-by-side blower arrangement in accordance with the present invention optimizes the effectiveness of airflow in achieving uniform air temperature distribution by creating primarily horizontal circulating airflow fields. Having multiple blower units operating simultaneously also increases airflow capacity, thereby minimizing the time to recover air temperature uniformity after the oven door is opened and re-closed.

Further objects, features, and advantages of the present invention will be apparent from the following detailed description when taken in conjunction with the accompanying drawings.

DETAILED DESCRIPTION OF THE INVENTION

An exemplary forced air convection oven in accordance with the present invention will be described in detail with reference to the attached figures. For convenience, the following description refers to air as the convecting gas; however, any suitable gas, examples of which include nitrogen, steam, combustion gases from a gas-fired heating element, or a combination of such gases, may be used as well. Similarly, the following description refers to use of food in the invention in a convection oven for cooking food. It should be understood, however, that the present invention may be used to process any material suitably processed in a convection oven, including materials processed using flow-through ovens such as solderable circuit boards or web materials.

Figure 1:
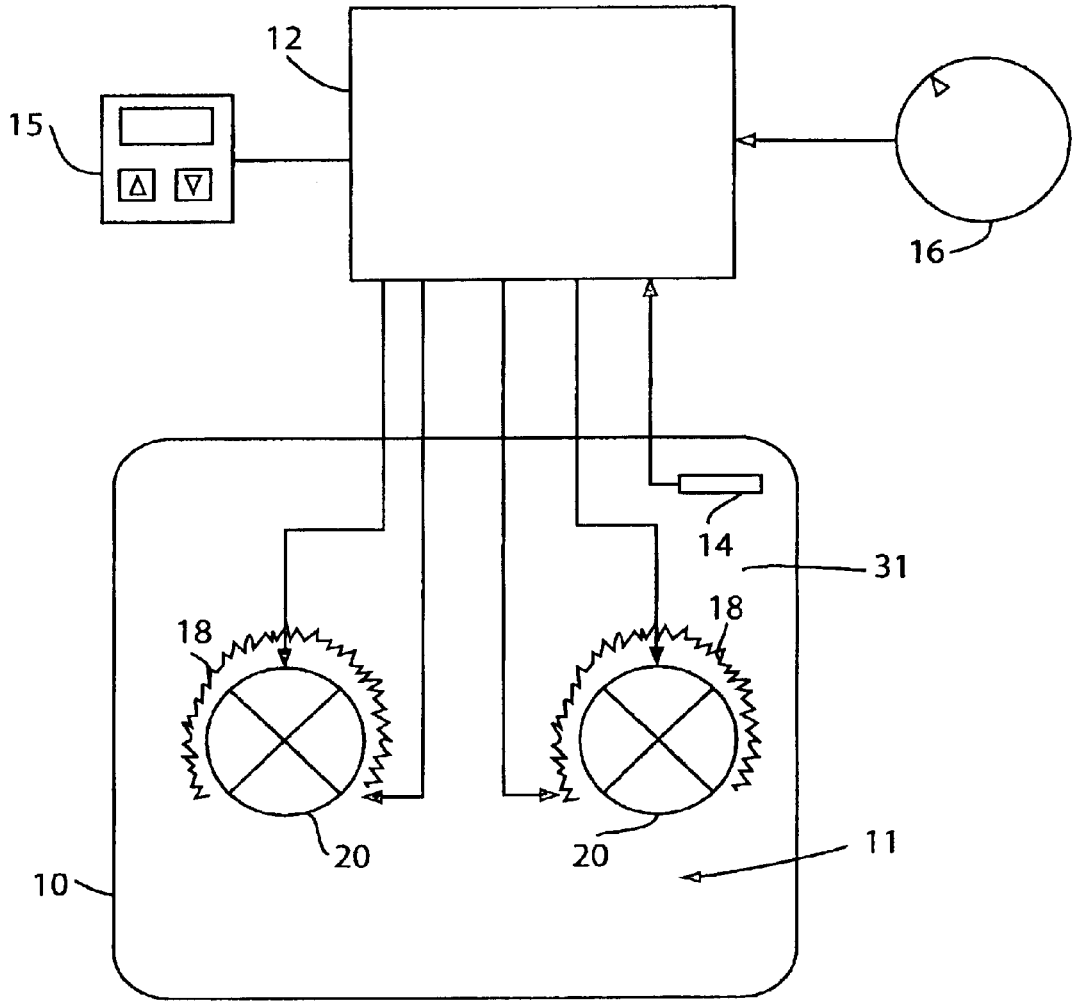
FIG. 1 is a schematic diagram of an exemplary convection oven with forced airflow circulation zones in accordance with the invention.

As shown in schematic view in FIG. 1, a forced air convection oven in accordance with the present invention may include an oven chamber 10 surrounding an internal cavity 11, a controller 12, a temperature sensor 14, a temperature selector 15 providing a temperature selector input, a mode selector 16 providing a mode selector input, at least one heating element 18, and at least two blowers 20 to force air circulation in the oven cavity. The state of the manually operable mode selector 16 determines an input for a mode of cooking. A controller 12 regulates oven cavity air temperature by monitoring the temperature selector 15 and feedback from a temperature sensor 14 and setting the operating state of the blowers 20 and the heating elements 18 in accordance with the selected mode of cooking.

Figure 2:
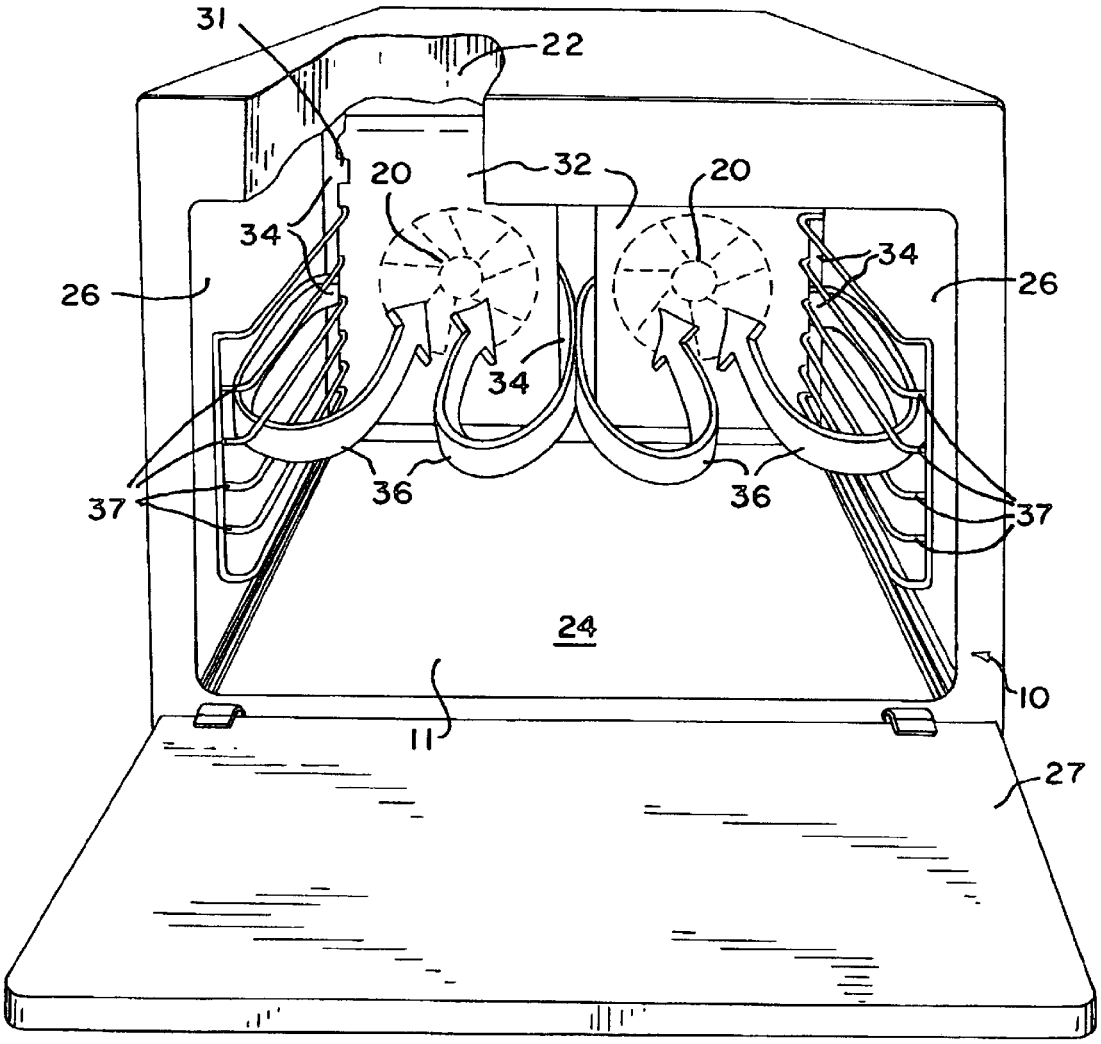
FIG. 2 is a perspective view of an exemplary convection oven with forced airflow circulation zones in accordance with the invention.
Figure 3:
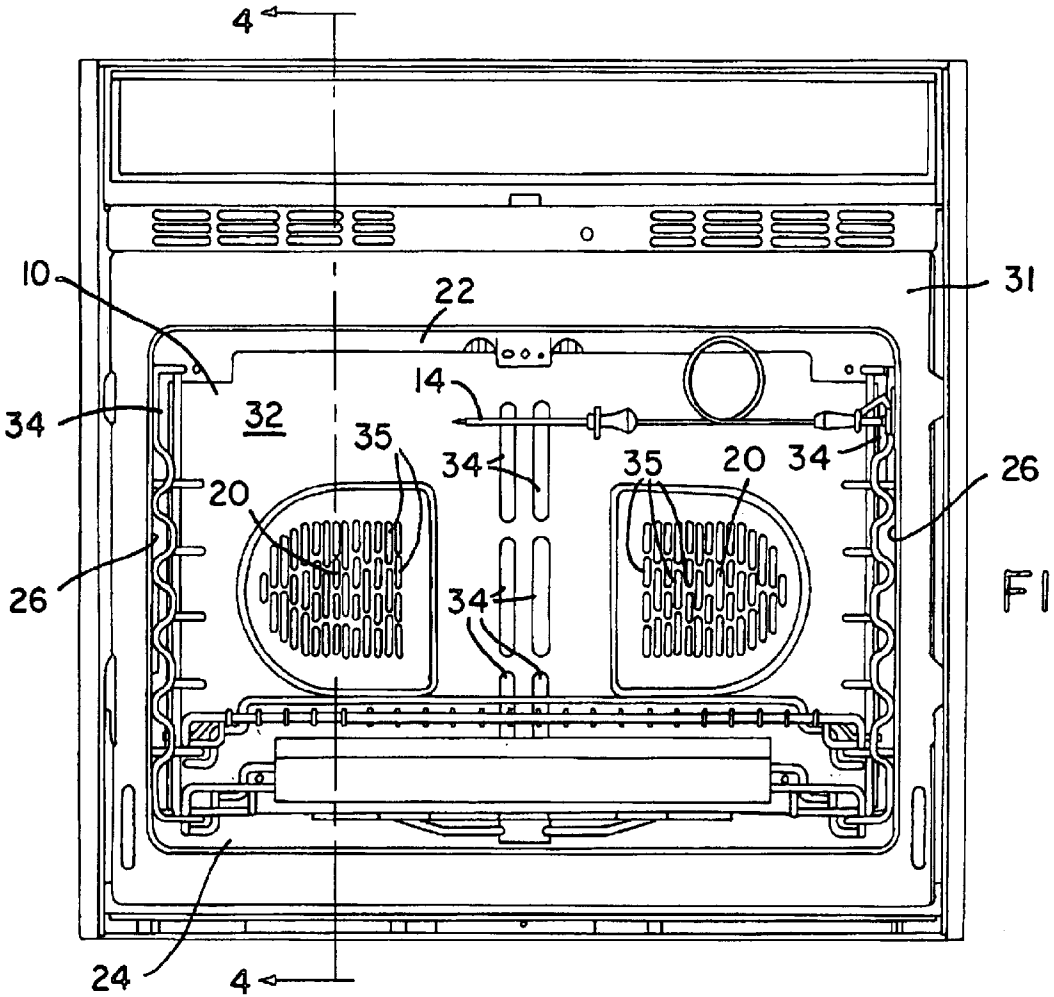
FIG. 3 is a front view of an exemplary convection oven with forced airflow circulation zones in accordance with the invention (with the front door removed).
Figure 4:
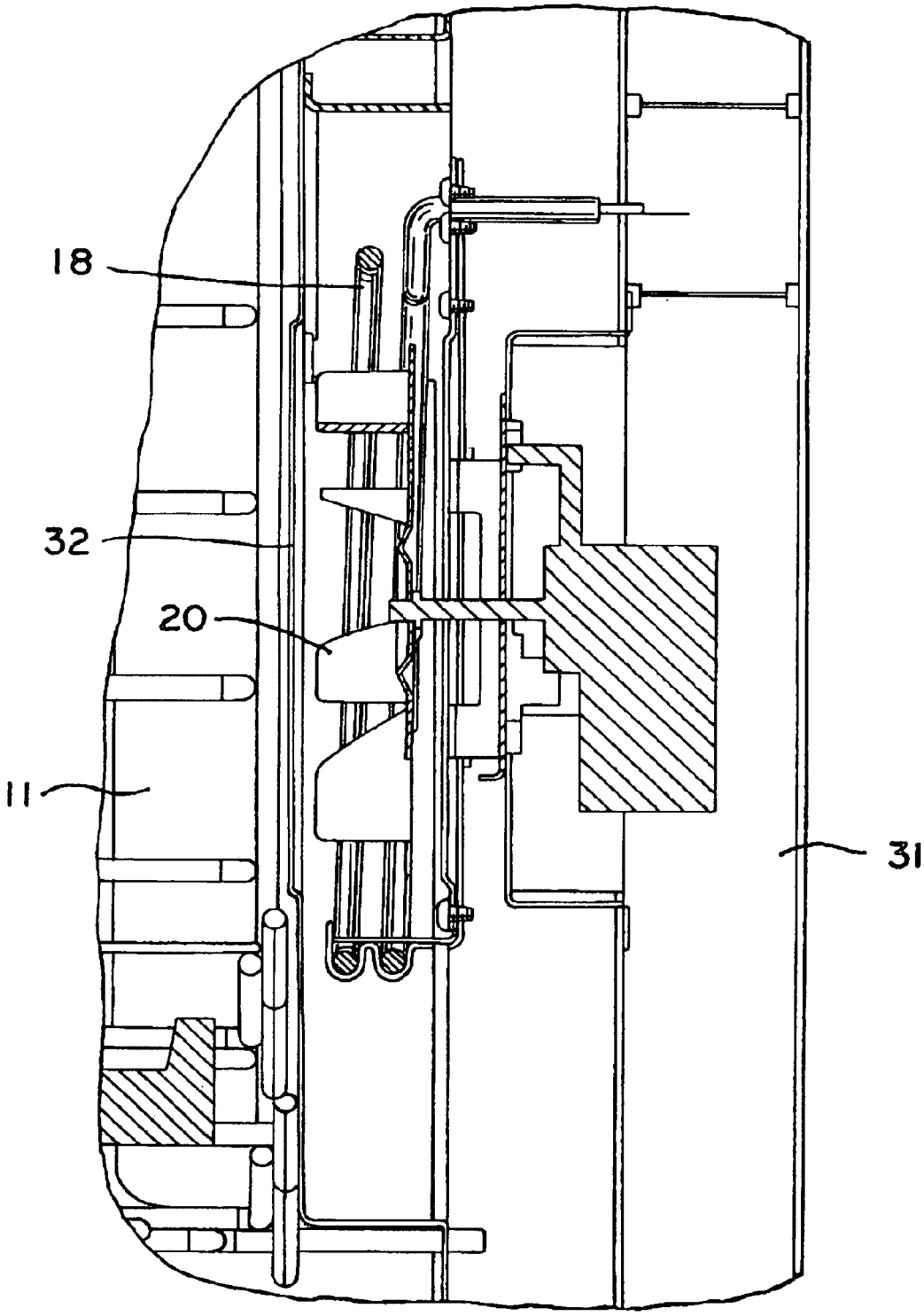
FIG. 4 is a partial detailed cross-section view of an exemplary embodiment of the invention as taken along the line 4—4 of FIG. 3.
Figure 5:
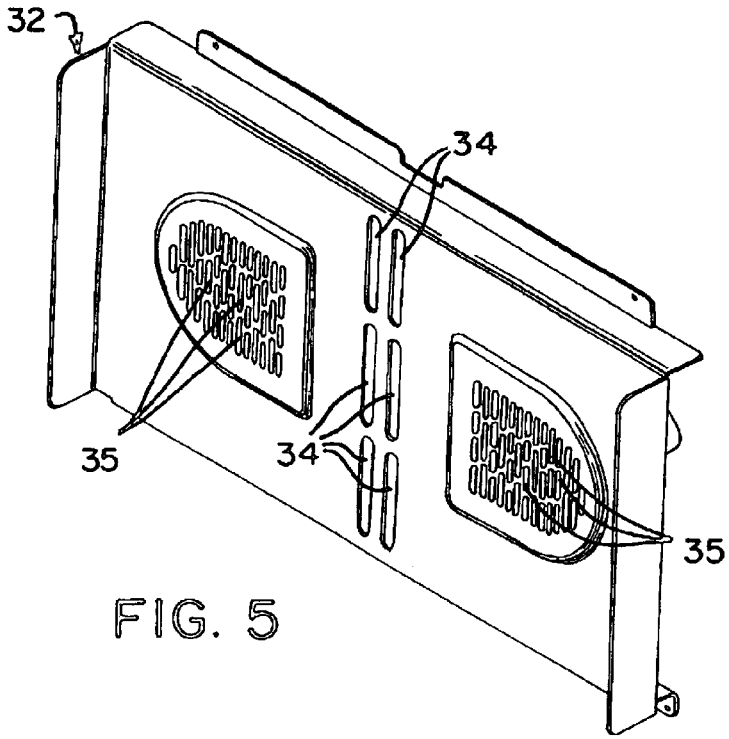
FIG. 5 is a front perspective view of an exemplary blower baffle as employed in a convection oven with forced airflow circulation zones in accordance with the invention.
Figure 6:
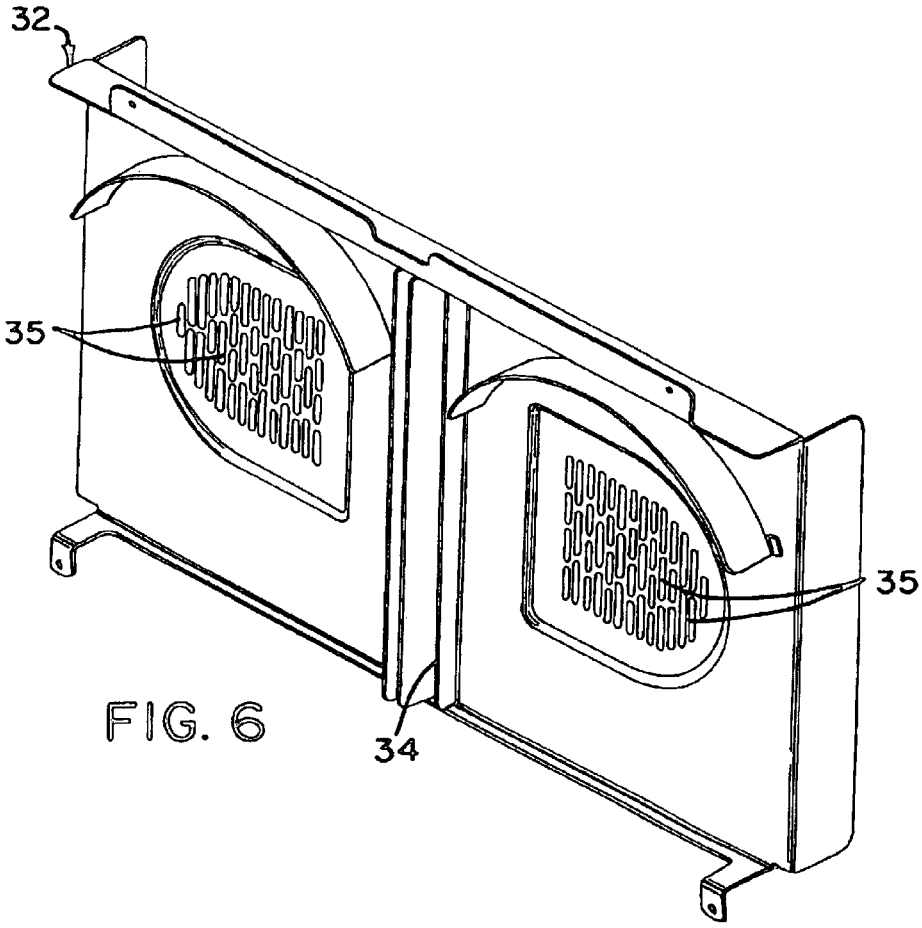
FIG. 6 is a back perspective view of the blower baffle of FIG. 5.
Figure 7A:
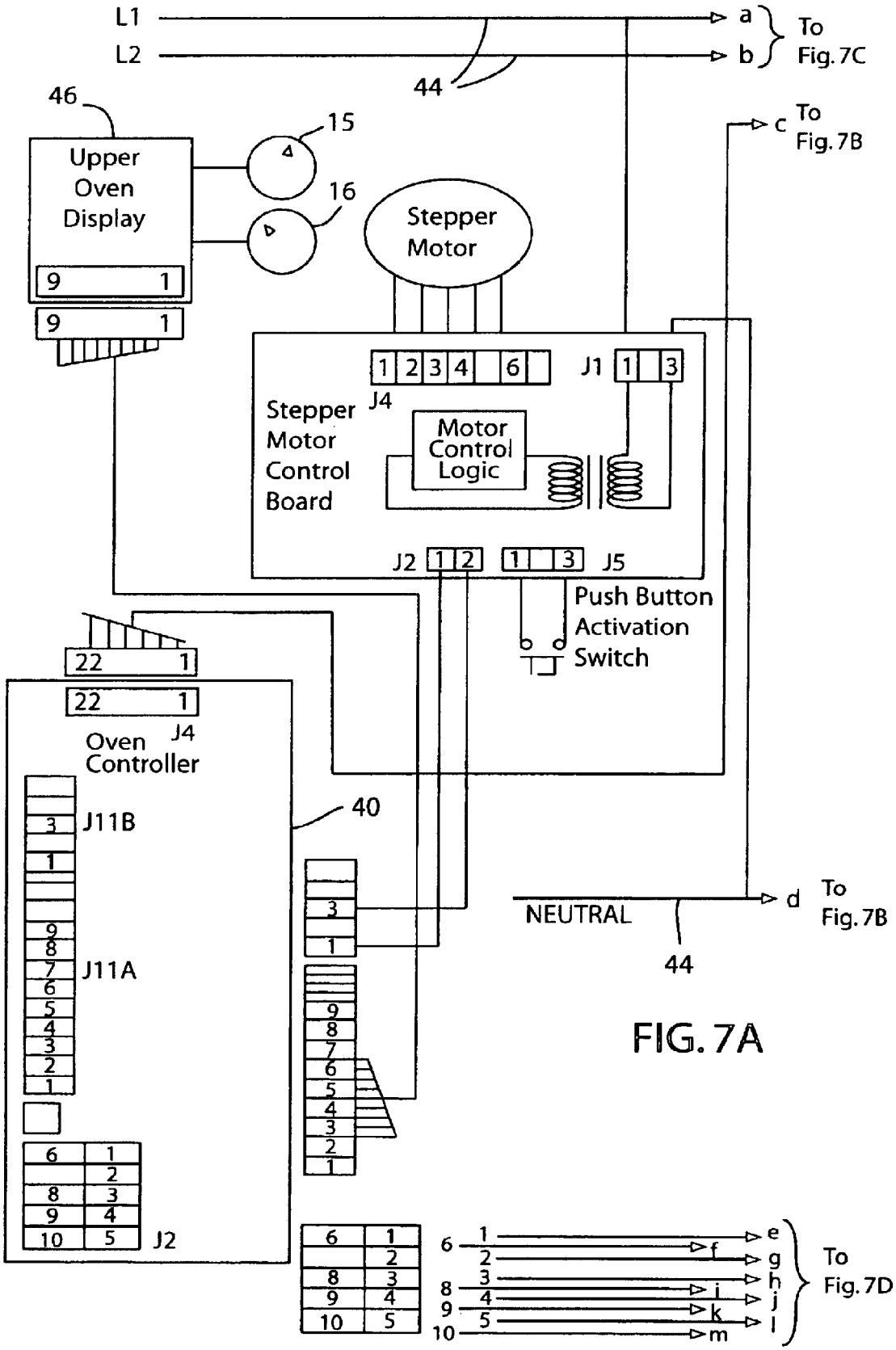
FIG. 7 is a schematic diagram of the controls for a preferred embodiment of a convection oven with forced airflow circulation zones in accordance with the invention.
Figure 7B:
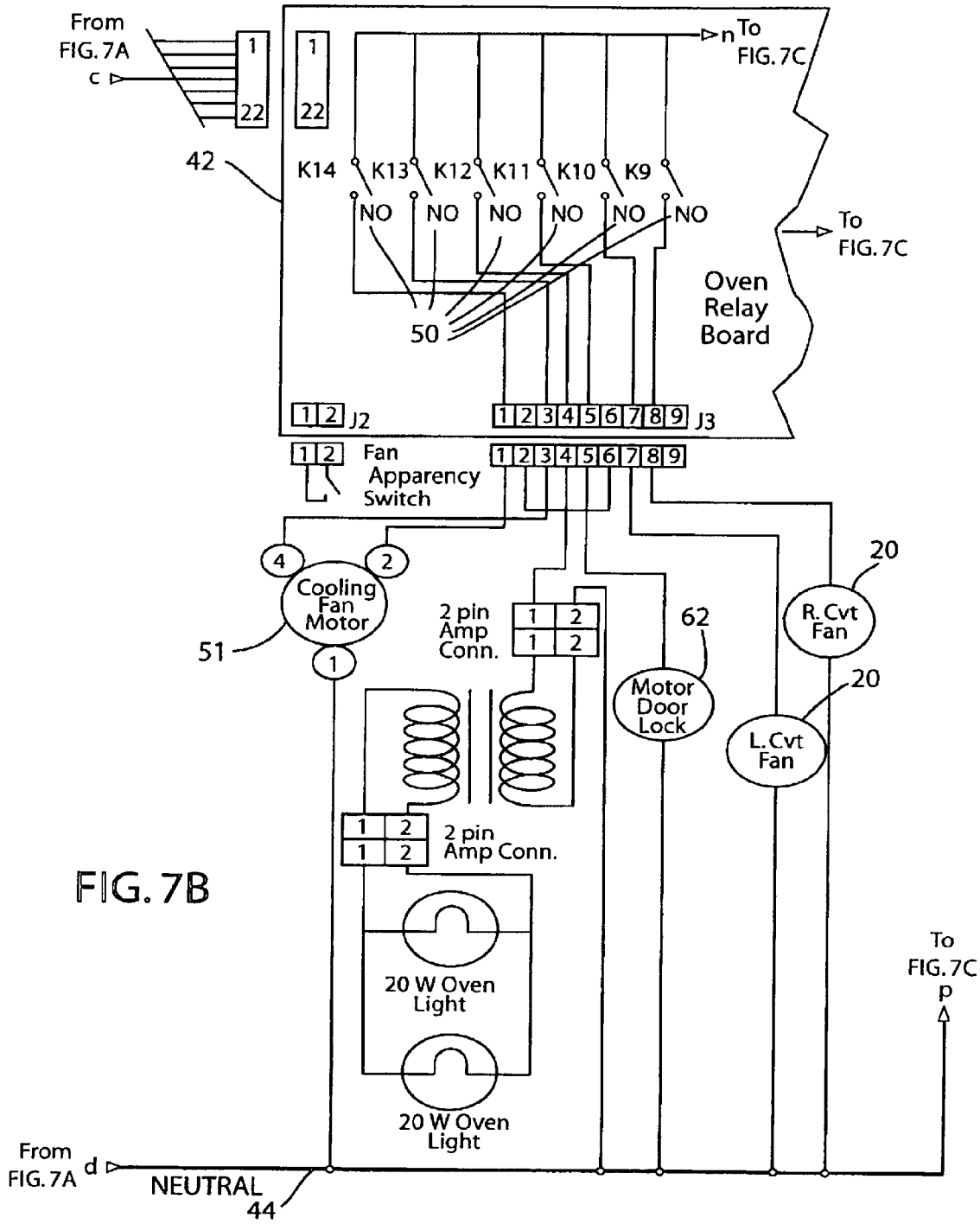
Figure 7C:
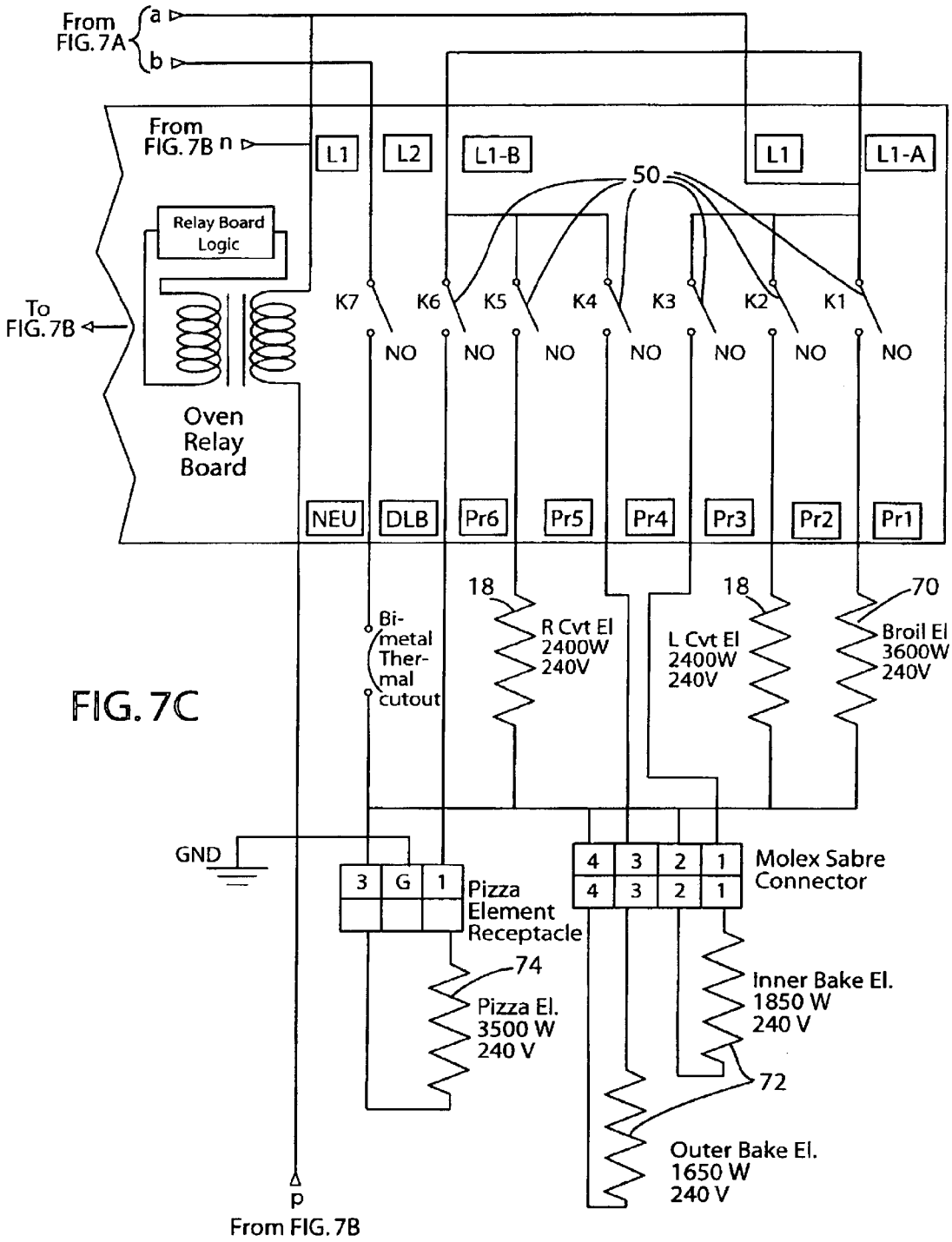
Figure 7D:
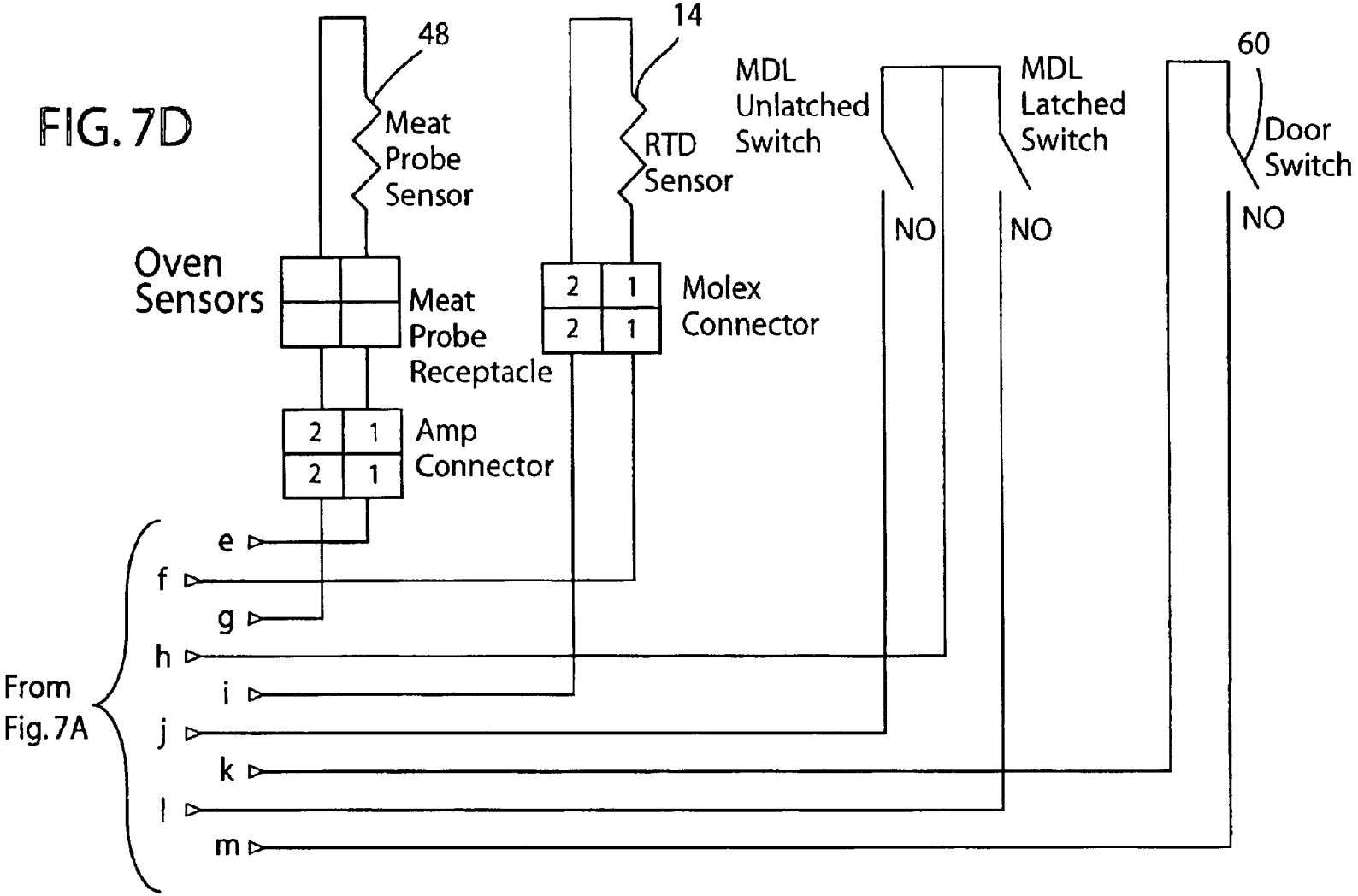
Figure 8A:
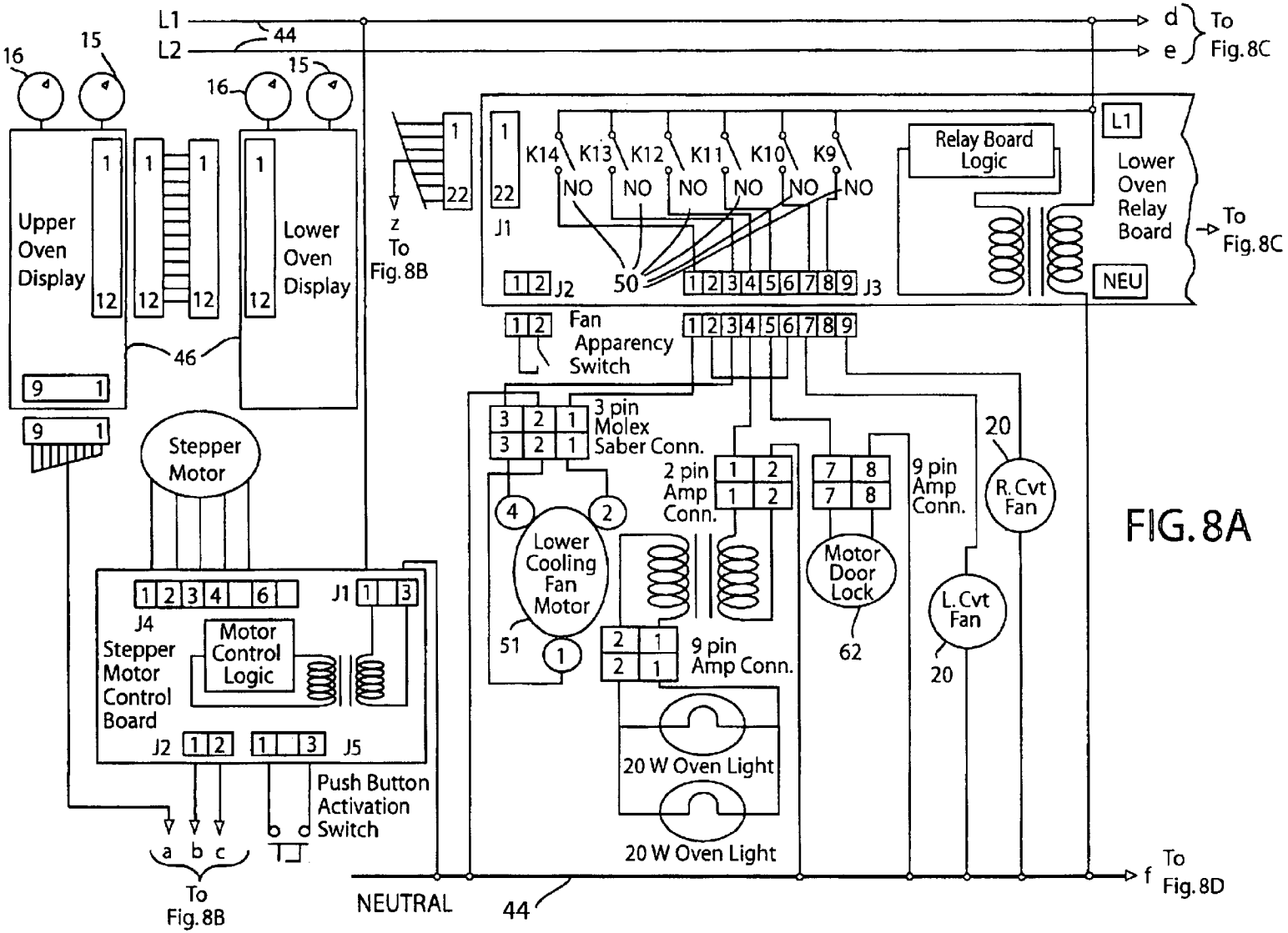
FIG. 8 is a schematic diagram of the controls for a preferred embodiment of a dual chamber convection oven with forced airflow circulation zones in accordance with the invention.
Figure 8B:
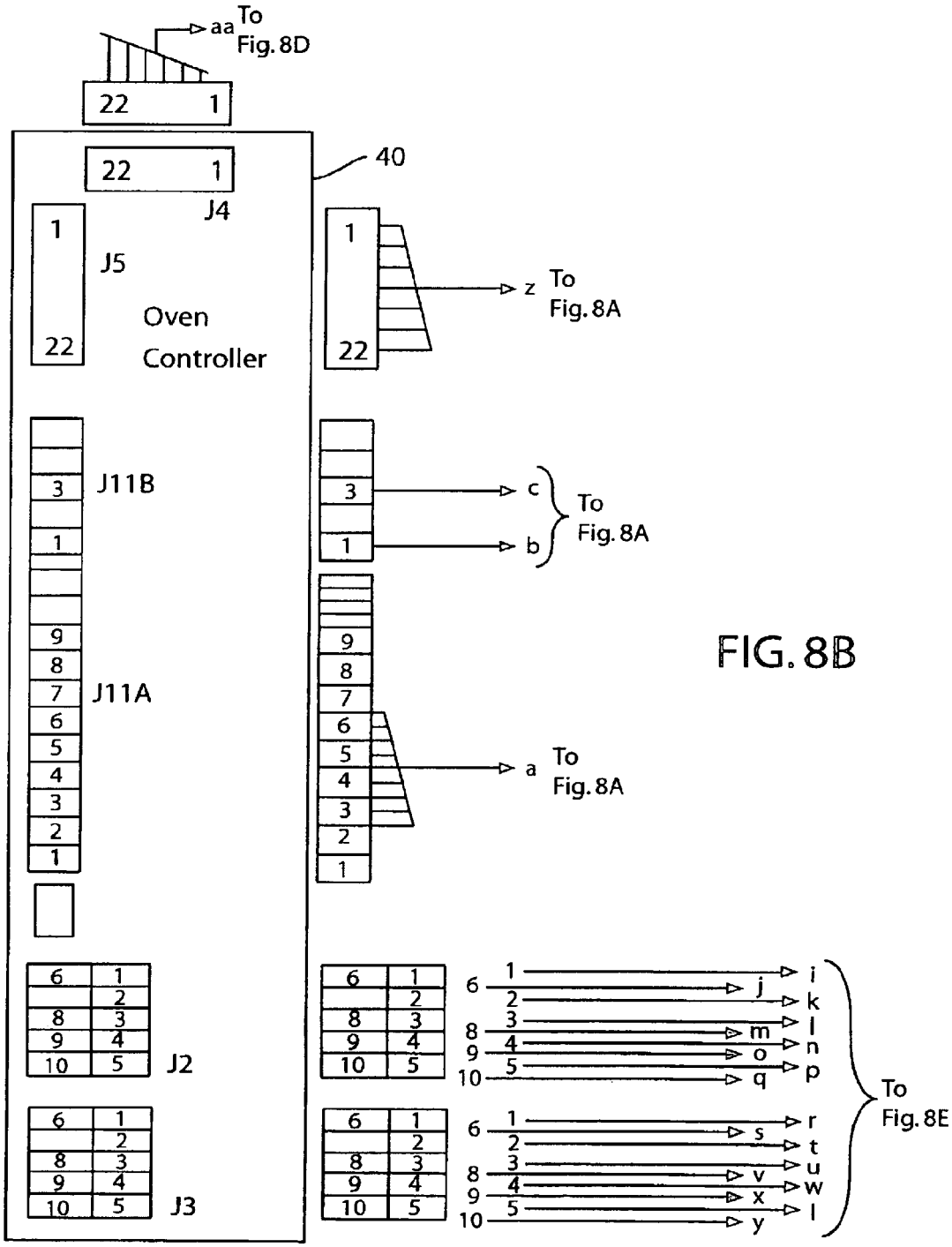
Figure 8C:
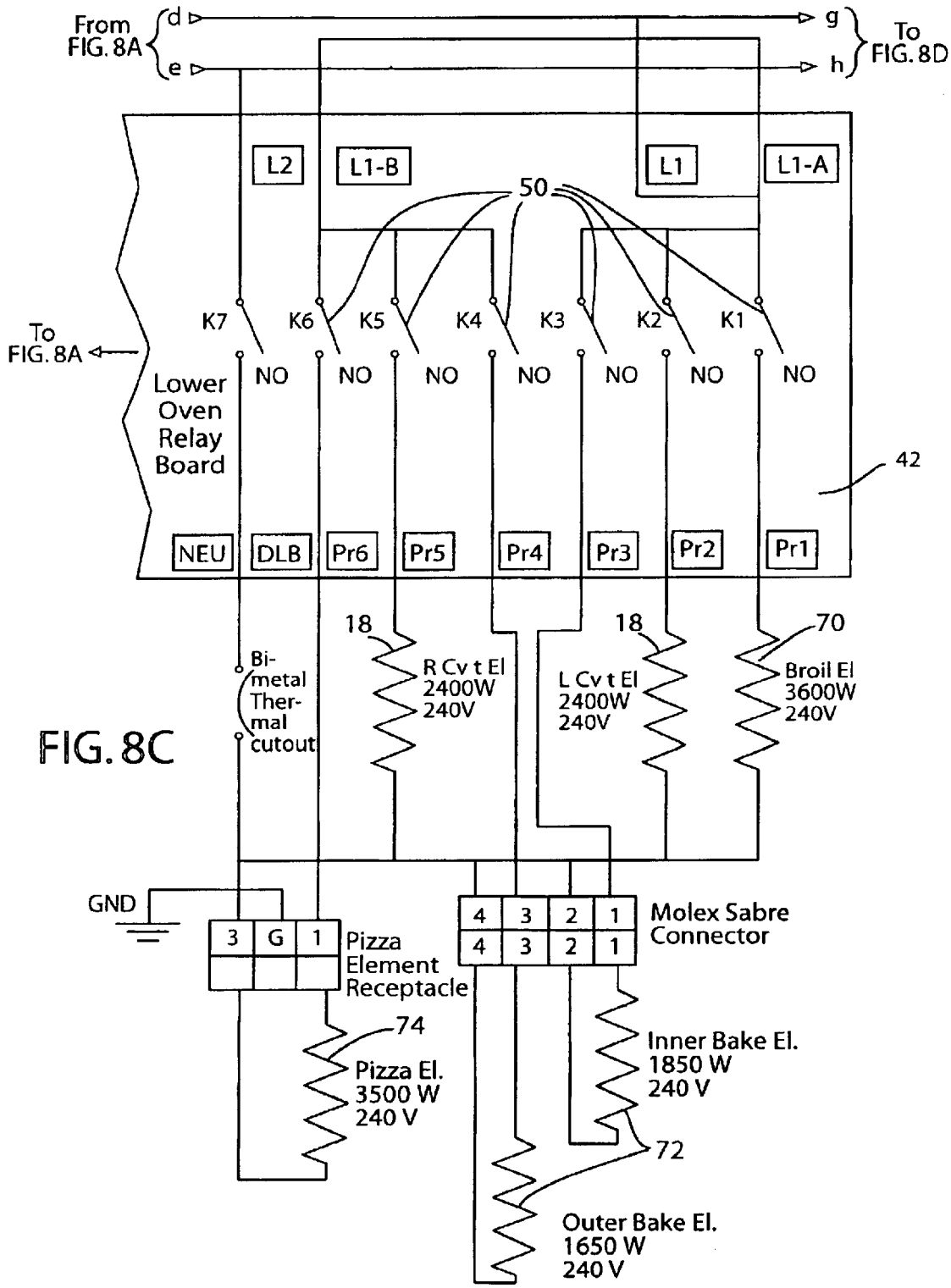
Figure 8D:
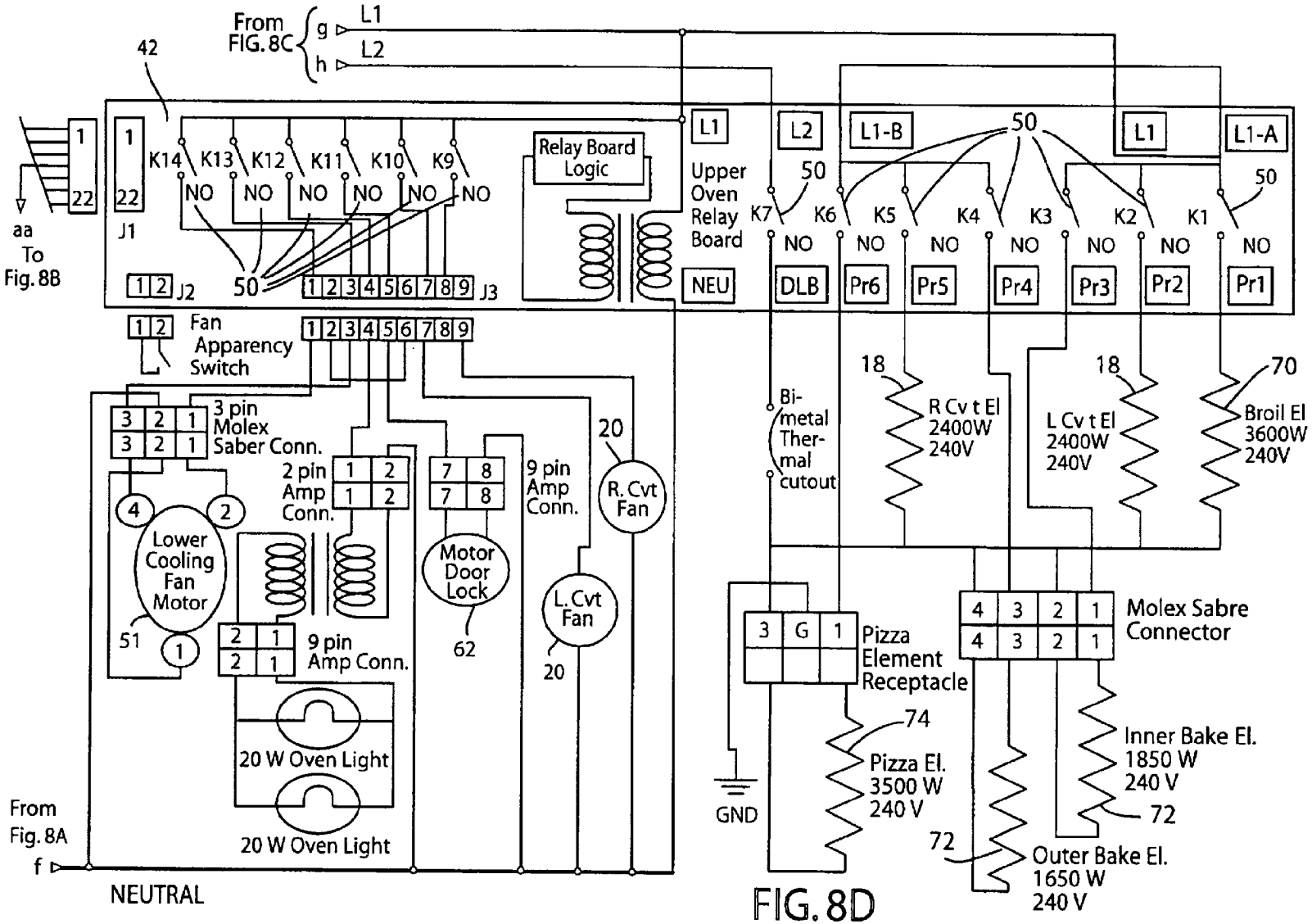

As best shown in FIG. 2, in the preferred embodiment of the present invention, the oven chamber 10 has fixed, unheated cooking surfaces surrounding the oven cavity 11, including a top wall 22, a bottom wall 24, two side walls 26 and a door 27 at the front of the oven to permit food to be placed in and removed from the oven cavity 11. Preferably, at least two blower units 20, preferably located horizontally adjacent to one another opposite the oven door 27, are mounted on a back wall 31 behind a baffle 32 having slots 34 formed therein that divide the airflow generated by the blowers 20 to obtain circulating zones of airflow 36. The slots 34 are preferably formed at the middle of baffle 32, and along left and right edges of baffle 32 which form an exhaust slot with left and right side walls 26 as shown in FIG. 3). In a preferred embodiment, the two blowers 20 may be identical except that they may be operated to counter-rotate to promote more uniform air temperature distribution throughout the oven. Both blowers 20 intake air from the oven cavity 11 (e.g., air intake slots 35 on the baffle 32 as shown in FIG. 3). The blowers 20 then may exhaust the air across a heating element 18, such as, for example, a conventional electrical resistance Calrod element, to produce a flow of hot air, as shown in FIG. 4. The flow of hot air exits the fan area through baffle slots 34 (shown in FIG. 3) around the left and right outer edges and at the central area of the baffle 32, as may be appreciated from the perspective views of the baffle 32 in FIGS. 5 and 6. The air then re-enters the oven cavity 11, and circulates in distinct circulating zones 36, substantially in the horizontal plane, as best shown in FIG. 2. Food to be cooked can be placed on a plurality of conventional adjustable-elevation horizontal racks (not shown) in the oven cavity 11. A plurality of rack supports 37 may be provided on the oven side walls 26 for this purpose.

In a preferred embodiment, the blowers 20 are mounted and positioned on the back wall 31 opposite a door 27 on the front of the oven, but the invention is not limited to a convection oven having a door in this configuration. The blowers 20 can be mounted on any other wall of the oven cavity, including the side walls 26, top wall 22, bottom wall 24, or on the door 27. Furthermore, having a door as the front wall of the oven chamber is not a requirement for this invention, as the invention may be incorporated, for example, in an oven with at least one partially open side as in a flow-through oven, or, alternatively, as in an oven with a door in the top wall 32. The shape of the oven cavity 11 is typically square or rectangular, but it could include curved or angled walls. Although not shown in the drawing, the oven cavity 11 would typically contain the usual complement of racks and lighting or, as in the case of flow-through convection ovens, a conveyor track or process web path.

The dimensions of the substantially enclosed cavity 11 of the oven chamber 10 are selectable in accordance with the size and placement of the objects to be processed. The dimension from the blower to the opposite wall should not exceed the effective capacity of the blower and any baffle to produce effective and uniform zones of circulating air in the horizontal plane. As an example, the typical dimension from a blower to the opposite wall of a chamber incorporating a small radial fan is two to four feet, although the effective dimension depends upon the blower capacity to circulate air without damage, as for example, by causing bakery items to lean. A convection oven in accordance with the present invention, such as a flow-through oven, for example, may incorporate any number of horizontally adjacent blowers to adapt to the length of its enclosure. Similarly, the invention can be adapted to any suitable vertical dimension of a substantially enclosed oven chamber by stacking rows of at least two horizontally adjacent blowers.

The blowers 20 may preferably be implemented as a fan arranged with a baffle 32, but could incorporate other equivalent mechanisms to force air circulation. The blowers 20 in the preferred embodiment employ a baffle 32 having exit slots 34 designed to circulate air in circulating zones of airflow 36 from the driving blowers 20. A baffle may not be necessary to obtain the benefits from additional blowers. Where the blowers 20 are implemented as fans, they may be of any suitable type, for example, axial or radial fans. In the preferred embodiment, each operating radial fan intakes air from the cavity 11 and distributes it to a plurality of exit slots 34 on the left and right sides of the fan. This distribution avoids the creation of a localized high pressure airflow toward the food. However, the invention is not limited to radial fan types. An axial fan, for example, might be advantageous in industrial convection or other oven applications.

One advantage of the present invention is the creation of circulating zones of airflow 36 which primarily circulate in a substantially horizontal plane. In a preferred embodiment, each blower 20 creates two major circulating zones of airflow 36 in which the two zones are adjacent and counter-rotating. The baffle slots 34 are preferably located on both sides of the blower axis. The resulting circulation, being substantially in a horizontal plane, flows toward the front wall or door 27 of the oven cavity 11 and returns to the blower 20 intake substantially along the blower axis, as shown in FIG. 2. This airflow structure minimizes the potential for highly non-uniform airflow paths to be broken up or blocked by the configuration of objects placed on the horizontal grills or, as in a flow-through oven, on a conveyor system. Furthermore, substantially horizontal airflow reduces the non-uniformity of air temperature distribution within the cavity 10 as found in, for example, linear or vertical airflow systems.

The configuration of blowers employed in the present invention may be expanded by having a greater number of horizontally adjacent blowers 20 in a row and by having a number of vertically stacked rows. Two or more blowers 20 may be adjacently mounted in a horizontal row to produce an effective number of zones of circulating airflow 36 to adapt to the width of the oven. For ovens having a tall height relative to the effective height of the zones of circulating airflow 36, additional rows of blower units may be stacked vertically to extend the effective height of the zones of circulating airflow 36.

The present invention pertains to convection heating, but may be applied to combination cooking apparatus and methods, including, for example, convection heating in combination with microwave, radiant, or infrared heating. The heating element in the preferred embodiment is a resistive element (e.g., a conventional Calrod heating element) surrounding the perimeter of a radial fan. To prevent the open coil heating element from over-heating, the heating element is normally controlled to be energized only while the adjacent fan (i.e., the fan surrounded by the heating element) is operating and thereby able to promote a high heat transfer rate from the heating element to the circulating air. It should be understood, however, that the invention is not limited to heating elements that are located directly in the blower exhaust path or to resistive heating elements. Alternative heating element embodiments include infrared sources, gas-fired combustion chambers, and resistive heating elements fixed to a sidewall of the oven cavity. To promote the above-described horizontally circulating airflow zones, the present invention may, for example, be controlled to selectively operate the radial fans in combination with the operation of conventional broiler heating elements mounted near the top wall of the oven chamber. Alternatively, the present invention may be controlled to selectively operate the radial fans in combination with operation of conventional heating elements mounted near the bottom wall of the oven chamber.

The airflow management provided by the present invention could be applied to achieve uniform temperature regulation in an enclosure at any temperature, including ambient or refrigerated temperatures. To incorporate refrigeration, a mechanism for lowering temperature may either replace or supplement heating element 18. In combination with a humidity control mechanism, the airflow management provided by this invention can also produce uniform and efficient product drying, curing, or moisturizing. To incorporate humidity control, a mechanism for regulating humidity may either replace or supplement the heating element 18. Thus, the present invention can provide efficient airflow management in an oven cavity with any combination of heating, refrigeration, or humidity control.

The temperature selector 15 may be supplemented in a conventional manner, e.g., as a variable resistance or other dial selector, or as a digital push-button device. The cooking mode selector 16 input is preferably a multi-position switch arrangement, but it could be any other suitable digital, analog, or equivalent input for commanding the operating mode to the controller 12. Similarly, the controller 12 is preferably a primarily digital circuit, but it could also be primarily analog, mechanical, or any equivalent suitable to control the heating elements 18 and blowers 20 based on temperature probe 14 feedback and temperature selector 15 and mode selector 16 input signals.

The controller 12, along with its inputs and outputs, are represented schematically in a preferred embodiment of the present invention in FIG. 7. A preferred embodiment of a dual chamber oven in accordance with the present invention is similarly represented in FIG. 8, and it may be appreciated that the following description with reference to a single chamber oven embodiment shown in FIG. 7 may be extended to a preferred dual chamber oven embodiment as shown in FIG. 8.

With reference to the exemplary configuration of the present invention shown in FIG. 7, the functions of controller 12, described in detail elsewhere herein, may be carried out by circuitry, in cooperation with any required software, on an oven controller board 40 and an oven relay board 42. Power to the controller is provided by a conventional power supply (not shown) that receives power from an A.C. mains supply 44, which may typically provide 240 Volts (r.m.s.) at a line frequency of 50–60 Hz. The controller board 40 communicates with an upper oven display interface 46, which accepts the temperature selector input from temperature selector 15 and the mode selector input from mode selector 16. The oven display interface 46 may optionally include a visual display (not shown) of oven status information from the oven controller board 40, such as current mode and temperature. The oven controller board 40 also accepts a temperature input from at least one temperature sensor 14, such as an RTD sensor. Optionally, the oven controller board 40 may also receive feedback from an additional temperature sensor, such as a meat probe sensor 48. In the exemplary embodiment, oven controller board 40 may cooperate with the oven relay board 42 to control a plurality of relays 50 on the oven relay board 42 in accordance with the selected operating mode and selected temperature. In this preferred embodiment, the relays 40 are normally-open type relays. When the controller board 40 signals the oven relay board to activate a particular relay 50, then that relay closes, thereby permitting energy to flow from the A.C. mains supply 44 to an individual cooking element connected to that relay to cook the food in the oven cavity 11. For example, when the oven controller board 40 activates the relay connected to one of the blowers 20, that blower may then operate to circulate air in the oven through baffles 32 (not shown) substantially in the horizontal plane.

In a preferred embodiment, the oven chamber 10 may also include a cooling fan 51 to circulate air around the heat sensitive components associated with the controller 12, particularly the oven controller board 40 and oven relay board 42.

In a preferred embodiment, the oven chamber door 27 may optionally be monitored by a door switch 60 to provide a door switch input to oven controller board 40. In a preferred operating method, controller 12 may de-energize blowers 20 when oven door 27 is opened to reduce heat loss from the oven cavity 11. Furthermore, the oven chamber also may include, in a preferred embodiment in accordance with the present invention, oven door locks actuated by door lock motor 62 to automatically lock oven door 27 under certain conditions, such as high oven temperature. Such locks may be operated under control of the controller board 40.

The above-mentioned cooking elements in accordance with the present invention are illustrated schematically in FIG. 7. The cooking elements are configured to manipulate the air temperature profile in the oven cavity and may include heating elements and blowers in a preferred embodiment as follows. First, left and right blowers 20 are operable to circulate air in airflow zones as described elsewhere herein. Next, left and right heating elements 18, configured in the respective exhaust airflows from the left and right blowers 20, may heat the air expelled radially from the left and right blowers 20, respectively. In a preferred embodiment, heating elements 18 may individually be rated to provide, for example, 2400 Watts at 240 Volts (r.m.s.). Next, a broiler element 70 may be mounted in a recess that may be provided in the top wall 22. Such a broiler element may provide heat at the top of oven cavity 11. In a preferred embodiment, broiler element 70 may be, for example, an eight pass magnesium element oxide (MgO) of the type commonly referred to as Calrod. A suitable broiler element 70 is commercially available from Springfield Wire (headquarters in Springfield, Mass.; also available from http://www.springfield-wire.com). A further cooking element, commonly referred to as a bake element 72, may be disposed under the bottom wall 24 to provide heat from the bottom of oven cavity 11. In a preferred embodiment, bake element 72 may be, for example, a split element comprising two separate paths and providing a multiple pass open coil radiant element. A suitable bake element 72 element is commercially available from Ceramaspeed (headquarters located near Worcestershire, England; also available from http://www.ceramaspeed.com).

A preferred method of operating a convection oven in accordance with the present invention is in one of a plurality of modes, depending on the type of cooking desired. Although not to be considered as limiting, one basic operating method which may generally apply to each of the various operating modes may be generally described as follows. During normal cooking operations, the heating element 18 may be turned on only when the adjacent blower 20 is on and a desired temperature has been selected using the temperature selector 15. A blower 20 may be on when commanded by the controller 12 based on feedback from the temperature sensor 14 and the selected operating mode. Thus, the desired air temperature in oven cavity 11 may be maintained. Various cooking methods may extend this basic operating method to the control of at least two blowers 20 and their adjacent heating elements 18 in accordance with the present invention.

In addition to the conventional cooking modes previously known to those skilled in the art, the following exemplary modes of operating a convection oven having forced airflow circulation zones in accordance with the present invention may be referred to as: convection, convection bake, convection-roast, convection-broil, and bake stone cooking modes. Operating modes other than those to be described in detail below may also or alternatively be employed. Each of the exemplary modes below is described with reference to a preferred embodiment of the present invention, wherein the preferably two blowers 20 are two radials fans, and each fan has around its perimeter an adjacent open-coil heating element 18. It should be understood that the specific duty cycle numbers and percentages of cycling periods are in reference to a preferred embodiment of the present invention, and that a range of values may be used without departing from the spirit of the present invention.

The first exemplary mode of operation, convection mode, may include an optional preheating period followed by a normal cooking period. During the preheat period, both radial fans 20 and their adjacent heating elements 18 may be turned on at 100 percent duty cycle for a selected period of preheating time, or until the air in the oven cavity reaches a selected temperature. For approximately 30 percent of a preheat cycling period, bake heating element 72 may be energized, after which a broiler heating element 70 may be energized for approximately 60 percent of the preheating cycling period. During the normal cooking period, the controller 12 may repetitively operate the oven in a sequence of steps over a cooking cycling period, repeating the sequence for a selected period of time, or until, for example, the food is cooked to a desired degree. The sequence of steps during the cooking cycling period may include: energizing one of the two fans 20 and its adjacent heating element 18 for approximately 50 percent of the cooking cycling period, and then energizing the other fan 20 and its adjacent heating element 18 for the remaining approximately 50 percent of the cooking cycling period.

The second exemplary mode of operation, convection bake mode, may include an optional preheating period followed by a normal cooking period. During the preheating period, both radial fans 20 and their adjacent heating elements 18 may be turned on at 100 percent duty cycle for a selected period of preheating time, or until the air in the oven cavity 11 reaches a selected temperature. For approximately 30 percent of a preheat cycling period, bake heating element 72 may be energized, after which a broiler heating element 70 may be energized for approximately 60 percent of the preheating cycling period. During the normal cooking period, the controller 12 may operate the oven in a sequence of steps over a cooking cycling period, repeating the sequence for a selected period of time or until, for example, the food is cooked to a desired degree. The sequence of steps during the cooking cycling period may include: energizing a first of the two fans 20 for a first approximately 50 percent of the cooking cycling period, then energizing a second of the two fans 20 for the remaining 50 percent of the cooking cycling period. In addition, the sequence may also include operating the heating element 18 in the exhaust of the first fan 20 for a first 45 percent of the cooking cycling period (beginning with the energizing of the first fan 20), then energizing the heating element 18 in the exhaust of the second fan 20 for a subsequent 45 percent of the cooking cycling period, then energizing bake heating element 72 for the remaining approximately 10 percent of the cooking cycling period.

The third exemplary mode of operation, convection roast mode, may include an optional preheat period followed by a normal cooking period. During the preheating period, both radial fans 20 may be turned on continuously and their adjacent heating elements 18 may be turned on at a duty cycle of about 75 percent for a selected period of preheating time, or until the air in the oven chamber reaches a selected temperature. For approximately 30 percent of a preheat cycling period, bake heating element 72 may be energized, after which broiler heating element 70 may be energized for the remaining approximately 70 percent of the preheating cycling period. During the normal cooking period, the controller 12 may operate the oven in a sequence of steps over a cooking cycling period, repeating the sequence for a selected period of time or until, for example, the food is cooked to a desired degree. The sequence of steps during the cooking cycling period may include: energizing both fans 20 continuously, energizing both heating elements 18 for the first approximately 46 percent of the cooking cycling period, and then operating broiler heating element 70 for the final approximately 17 percent of the cooking cycling period.

The next exemplary mode of operation, convection broil mode, may include an optional preheating period followed by a normal cooking period. During the preheating period, both radial fans 20 may be turned on continuously for a selected period of preheating time, or until the air in the oven chamber reaches a selected temperature. During the preheating period, a conventional broiler heating element 70 may also be operated at about 100 percent duty cycle. During the normal cooking period, the controller 12 may operate the oven in a sequence of steps over a cooking cycling period, repeating the sequence for a selected period of time or until, for example, the food is cooked to a desired degree. The sequence of steps during the cooking cycling period may include: continuously energizing both fans and the broiler heating element 70 to achieve a high power broil. Alternatively, the broiler heating element 70 may be operated at a duty cycle of approximately 70 percent of the cooking cycling period to achieve a medium power broil. As a further alternative, the broiler heating element 70 may be operated at a duty cycle of approximately 50 percent of the cooking cycling period to achieve a low power broil.

The final exemplary mode of operation, bake stone mode, may include an optional preheating period followed by a normal cooking period. During the preheating period, both radial fans may be turned on continuously for a selected period of preheating time, or until the air in the oven chamber reaches a selected temperature. For approximately 75 percent of a preheat cycling period, a bake stone heating element 74 which may be mounted on a bake stone place in oven cavity, may be energized, after which broiler heating element 70 may be energized for the remaining approximately 25 percent of the preheating cycling period. During the normal cooking period, the controller 12 may operate the oven in a sequence of steps over a cooking cycling period, repeating the sequence for a selected period of time or until, for example, the food is cooked to a desired degree. The sequence of steps during the cooking cycling period may include: energizing bake stone heating element 74 for a first approximately 58 percent of the cooking cycling period, then energizing broiler heating element 70 for the remaining approximately 42 percent of the cooking cycling period. During operation of the broiler heating element 70 in this mode, the left fan may operate for a first approximately 21 percent of the cooking cycling period and the right fan may operate for the remaining approximately 21 percent of the cooking cycling period.

The cycling periods described in the above exemplary operating modes are periods of time during which the controller executes a sequence of operations in accordance with the selected operating mode. The controller 40 may preferably repeat the sequence for a plurality of cycling periods, including fractional periods, until a terminating condition is reached, such as reaching a selected air temperature in the oven cavity. For example, in convection or convection-bake type cooking, the preferred method of operating the blowers is to turn on one blower 20 for a portion of the cooking cycling period, and then to turn it off while turning on the other blower 20 for a similar portion of the cooking cycling period. The preferred cooking cycling period for conventional heating elements is 60 seconds, but may range from about 45 seconds to about 2 minutes for conventional ovens operating at conventional heating element temperatures. The optimal run period of each blower 20 should permit the heating element 18 sufficient time to reach adequate temperature for cooking, but not so much time as to permit the heating element to produce air temperatures that would result in, for example, the undesired edge-browning of bakery items. As for an example, a preferred run period may be at least 30 seconds but not more than 45 seconds.

A further embodiment of the present invention may include a first oven chamber in a stacked configuration above a second oven chamber, each oven chamber having, for example, two radial fans 20 surrounded by open coil heating elements 18, and baffles 32 in accordance with the present invention. Preferably, the stacked oven chambers would share a single controller 12, as shown in FIG. 8. In such a configuration, controller 12 may advantageously reduce peak current demand from the A.C. mains 44 by delaying the preheat of either oven by, for example, about 30 seconds if the other oven is actively in a convection mode preheat operation.

For convection-roast or convection-broil type cooking, the preferred method of operation is to run both blowers 20 simultaneously and continuously in opposite directions.

Such counter-rotating operation may promote enhanced zones of airflow having more uniform velocity so as to distribute air temperatures more evenly. The resulting airflow zones may circulate between each blower 20 and the oven door 27. Although in the preferred embodiment of a convection oven in accordance with the present invention, adjacent blowers 20 counter-rotate, adjacent blowers may also rotate in the same direction, or rotate in any combination of directions. Furthermore, individual blowers may be operated in accordance with the present invention using any combination or sequence of states including on, off, and periodic reversal of direction of rotation which may or may not include a period of time in the off state. The flexibility provided by such control methods permits the optimization of convection airflow in a wide variety of ovens for a wide variety of needs. For example, upon a door-opening event, the controller 12 may operate to switch the blowers 20 to a lower airflow rate to minimize the rate of heat loss out of the oven; subsequently, after the door re-closes, the controller 12 may switch temporarily to a high airflow rate (but not so high as to damage the food being cooked in the oven) to minimize air temperature recovery time.

It is understood that the present invention is not limited to the particular embodiments described herein, but embraces all such forms thereof that come within the scope of the following claims.

What is claimed is:

1. A convection oven, comprising:

(a) an oven chamber having an oven cavity containing a convecting gas;

(b) at least two horizontally adjacent blowers mounted to an inner wall of the oven cavity and operable to force the convecting gas to circulate through the oven cavity in a substantially horizontal plane;

(c) a temperature probe for measuring the temperature of the convecting gas in the oven cavity;

(d) a temperature selector providing a temperature selector input;

(e) a mode selector providing a mode selector input;

(f) at least two heating elements for heating the convecting gas blown by the blowers, wherein each element is mounted in the exhaust path of one of the blowers; and (g) a controller for controlling the at least two horizontally adjacent blowers and the at least two heating elements to achieve an operating temperature and mode as determined by the temperature selector and mode selector, wherein the controller is responsive to the temperature selector input, the mode selector input, and the temperature of the convecting gas as measured by the temperature probe;

wherein the oven chamber includes a door for accessing the oven cavity, and wherein the door is on a wall of the oven cavity opposite the blowers; and further comprising a baffle mounted to an inner wall of the oven cavity for controlling fluid communication between each of the two blowers and the oven cavity, wherein the baffle includes apertures distributed to the left and right of each blower so that the airflow exhausted radially from each blower enters the oven cavity therefrom, and the apertures being also distributed centrally around the rotational axis of each blower so that each blower may intake airflow from the oven cavity.

2. The convection oven of claim 1 wherein each of the blowers cooperates with the baffle to produce two horizontally adjacent and counter-rotating zones of airflow circulating substantially in the horizontal plane within the oven cavity.

3. The convection oven of claim 2 wherein the at least two horizontally adjacent blowers comprise radial fans.

4. The convection oven of claim 3 further comprising at least two heating elements for heating the convecting gas blown by each radial fan, wherein each element is mounted in the exhaust path of one of radial fans, and wherein each radial fan radially expels the convecting gas across one of the heating elements to heat the gas.

5. The convection oven of claim 4 wherein the at least one heating element is an electrically resistive open-coil element.

6. The convection oven of claim 5 wherein the convecting gas is air.

7. A convecting oven, comprising:

(a) an oven chamber having an oven cavity containing a convecting gas;

(b) at least two horizontally adjacent blowers mounted to an inner wall of the oven cavity and operable to force the convecting gas to circulate through the oven cavity in a substantially horizontal plane;

(c) a temperature probe for measuring the temperature of the convecting gas in the oven cavity;

(d) a temperature selector providing a temperature selector input;

(e) a mode selector providing a mode selector input;

(f) at least two heating elements for heating the convecting gas blown by the blowers, wherein each element is mounted in the exhaust path of one of the blowers; and (g) a controller for controlling the at least two horizontally adjacent blowers and the at least two heating elements to achieve an operating temperature and mode as determined by the temperature selector and mode selector, wherein the controller is responsive to the temperature selector input, the mode selector input, and the temperature of the convecting gas as measured by the temperature probe;

wherein the oven chamber includes a door for accessing the oven cavity, and wherein the door is on a wall of the oven cavity opposite the blowers; and wherein the controller operates the oven by executing the following sequence of operations:

(a) operating a first blower for a first selected length of time;

(b) operating a second blower for a second selected length of time; and repeating operations (a)–(b) for a third selected length of time.

8. A convection oven, comprising:

(a) an oven chamber having an oven cavity containing a convecting gas;

(b) at least two horizontally adjacent blowers mounted to an inner wall of the oven cavity and operable to force the convecting gas to circulate through the oven cavity in a substantially horizontal plane;

(c) a temperature probe for measuring the temperature of the convecting gas in the oven cavity;

(d) a temperature selector providing a temperature selector input;

(e) a mode selector providing a mode selector input;

(f) at least two heating elements for heating the convecting gas blown by the blowers, wherein each element is mounted in the exhaust path of one of the blowers; and (g) a controller for controlling the at least two horizontally adjacent blowers and the at least two heating elements to achieve an operating temperature and mode as determined by the temperature selector and mode selector, wherein the controller is responsive to the temperature selector input, the mode selector input, and the temperature of the convecting gas as measured by the temperature probe;

wherein the oven chamber includes a door for accessing the oven cavity, and wherein the door is on a wall of the oven cavity opposite the blowers; and wherein the controller operates all of the at least two horizontally adjacent blowers synchronously and at a selected duty cycle for a selected length of time.

9. A convection oven, comprising:

(a) an oven chamber having an oven cavity containing air, including a door for accessing the oven cavity;

(b) two radial fans operable to force air to circulate through the oven cavity in a substantially horizontal plane, wherein the two fans are mounted horizontally adjacent to one another on a wall of the oven chamber opposite the door; and (c) a baffle mounted to an inner wall of the oven cavity for controlling fluid communication between each of the two fans and the oven cavity, wherein the baffle includes apertures arranged to promote horizontally adjacent and counter-rotating zones of airflow circulating substantially in the horizontal plane within the oven cavity, the apertures being distributed to the left and right of each fan so that the airflow exhausted radially from each fan enters the oven cavity therefrom, and the apertures being also distributed centrally around the rotational axis of the fan so that the fan may intake the airflow from the oven cavity, wherein each of the two fans cooperates with the baffle to produce the two horizontally adjacent and counter-rotating zones of airflow circulating substantially in the horizontal plane within the oven cavity.

10. The convection oven of claim 9, further comprising:

(a) two open-coil resistive heating elements for heating the air blown by the fans, wherein each heating element is mounted in the exhaust path of one of the fans so that operating either one of the fans expels air radially across one of the heating elements;

(b) a temperature probe for measuring the air temperature in the oven cavity;

(c) a temperature selector providing a temperature selector input;

(d) a mode selector providing a mode selector input; and (e) a controller for controlling the fans and their respectively adjacent heating elements to achieve an operating temperature and mode as determined by the temperature selector and mode selector, wherein the controller is responsive to the temperature selector input, the mode selector input, and the temperature of the convecting gas as measured by the temperature probe.

11. The convection oven of claim 10 wherein the controller operates the oven by executing the following sequence of operations:

(a) operating a first of the two fans for a first selected length of time;

(b) operating a second of the two fans for a second selected length of time; and (c) repeating operations (a) to (b) for a third selected length of time.

12. The convection oven of claim 11, wherein the first selected time is between about thirty seconds and about one minute, and the second selected time is between about thirty seconds and about one minute.

13. The convection oven of claim 12, wherein further the third selected time is the length of time required for the air temperature in the oven cavity to reach a selected temperature as measured by the temperature probe.

14. The convection oven of claim 11 wherein the controller operates the two fans synchronously at a selected duty cycle for a selected length of time.

* * * * *

UNITED STATES PATENT AND TRADEMARK OFFICE

CERTIFICATE OF CORRECTION

PATENT NO. : 6,943,321 B2
DATED : September 13, 2005
INVENTOR(S) : Philip Carbone et al.

It is certified that error appears in the above-identified patent and that said Letters Patent is hereby corrected as shown below:

Column 14,
Line 17, "convecting" should be -- convection --.

Signed and Sealed this

Twenty-eighth Day of March, 2006

JON W. DUDAS
*Director of the United States Patent and Trademark Office*